United States Patent [19]

Hoyt, Jr.

[11] 4,054,121

[45] Oct. 18, 1977

[54] ADJUSTABLE MOUNTING MEANS FOR ARCHERY BOW STABILIZERS

[76] Inventor: Earl H. Hoyt, Jr., 11510 Natural Bridge Road, Bridgeton, Mo. 63044

[21] Appl. No.: 716,883

[22] Filed: Aug. 23, 1976

[51] Int. Cl.[2] ..... F41B 5/00

[52] U.S. Cl. ..... 124/89; 124/24 R

[58] Field of Search ..... 124/89, 88, 24 R, 23 R, 124/22, 24, 23

[56] References Cited

U.S. PATENT DOCUMENTS

| | | | |
|---|---|---|---|
| 3,752,142 | 8/1973 | Morita et al. | 124/89 X |
| 3,804,072 | 4/1974 | Izuta | 124/89 X |

*Primary Examiner*—Richard C. Pinkham
*Assistant Examiner*—William R. Browne
*Attorney, Agent, or Firm*—Charles E. Markham

[57] ABSTRACT

A device for mounting a pair of stabilizers for adjustable angular projection from opposite sides of a bow includes a transverse mounting bar attached to a face of a bow and extending from opposite sides thereof; a rotatably adjustable member is mounted on each end of the bar for rotation on an axis longitudinallly of the bar; each member has one or more screw threaded bores therein lying at an acute angle to an outward projection of its axis of rotation adapted to receive a screw threaded stabilizer rod.

In another form of the invention a first rotatably adjustable member is mounted on each end of a transverse mounting bar for rotation on an axis longitudinally of the bar and a second rotatably adjustable member is mounted for rotation on each of the first members on an axis perpendicular to the mounting bar; the second members each have a screw threaded bore therein perpendicular to its axis of rotation receiving a screw threaded stabilizer rod.

A mechanism for indicating the angularly adjusted positions of the rotatably adjustable members is provided in both forms of the invention and a device for locking the second members in adjusted position by rotation of the stabilizer rod is included in the second form.

10 Claims, 13 Drawing Figures

10
12
16
18
20
14
60
90
92
7
7

70
72
74
68
64
66
102
104
62
16
74
72
70

70
62
84

84
90
92
62
84
12
12

78
80
82
70
72

78
86
98
88
100
12
12
84

92
90
14
16
60
90
92

84
78
95
88
90
86
70
62
74
94
96
76

ADJUSTABLE MOUNTING MEANS FOR ARCHERY BOW STABILIZERS

This invention relates generally to archery equipment and particularly to means for mounting a pair of stabilizers, each comprising a rod with a weighting element at one end, for angular positioning on opposite sides of a bow.

BACKGROUND OF THE INVENTION

It has been proposed in U.S. Pat. No. 3,196,860 that stabilizers each comprising a rod with a weighting element at one end be mounted on the forward face of a bow and extend forwardly thereof and that they may also be mounted on opposite sides of a bow and extend outwardly from the sides thereof. It has also been proposed, in U.S. Pat. No. 3,752,142, that stabilizers of this kind be mounted on opposite sides or on the rear face of a bow and extend rearwardly of the bow on opposite sides of the bow string so as to balance any other forwardly extending stabilizers which be attached to the bow. It is also suggested in U.S. Pat. No. 3,752,142 that universal joints be employed to vary the level angle of the rearwardly extending stabilizers.

A conveniently adjustable means for mounting a pair of stabilizers of the kind described so that they may be extended outwardly at various angles from opposite sides of a bow both horizontally and vertically is a highly desirable accessory. Such an arrangement enables the individual archer to fine tune an individual bow to achieve the optimum consistancy of the flight of arrows of particular weight and spine. It is also desirable to include means in such adjustable mounting means to clearly indicate adjusted angular positions of the stabilizers and to provide for the convenient locking of the stabilizers in an adjusted position and their release therefrom.

An object of this invention is to provide a generally new and improved stabilizer mounting device which provides for the variable angular extension of a pair of stabilizers both horizontally and vertically from opposite sides of a bow.

A further object of the invention is to provide an adjustable stabilizer mounting means including a pair of stabilizers comprising a rod with a weighting element at one end which provides for the infinitely variable angular extension of the stabilizers from opposite sides of the bow.

A further object is to provide means for indicating the angular positions of the stabilizers.

A further object is to provide a novel and convenient means for releasably securing the stabilizers in an angularly adjusted position.

Further objects and advantages will appear from the following description when read in connection with the accompanying drawings.

FORM OF ADJUSTABLE STABILIZER MOUNTING DEVICE OF FIGS. 1 TO 5

Figure 1:
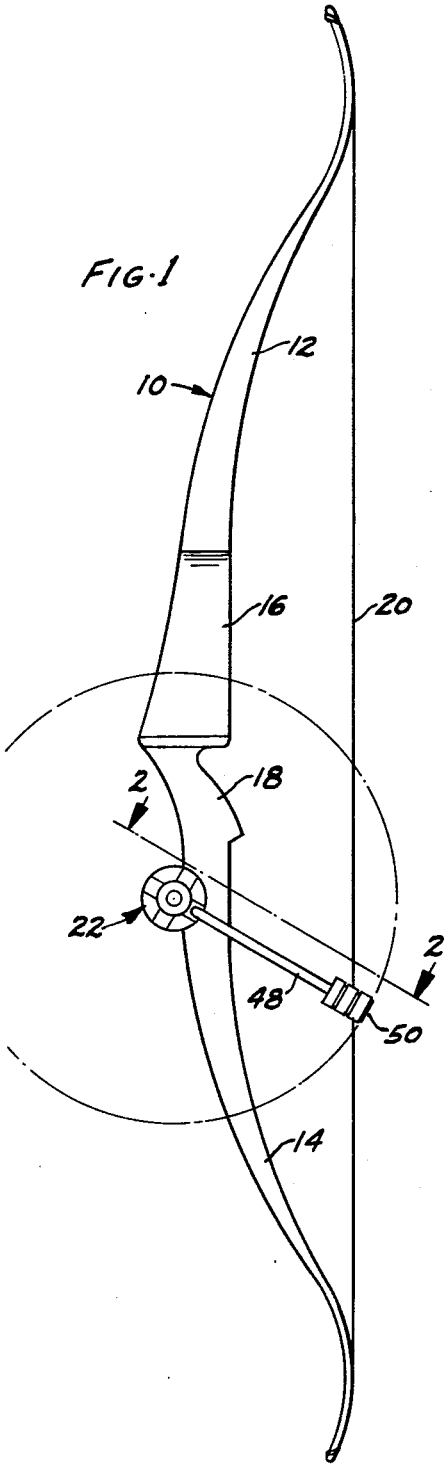
FIG. 1 is a side elevational view of an archery bow having mounted on the forward face thereof a stabilizer mounting device with stabilizers attached and is constructed in accordance with the invention.

Referring to FIGS. 1 to 5 of the drawings, an archery bow generally indicated at 10 has upper and lower bow limbs 12 and 14, a relatively rigid intermediate handle section 16 including a hand grip portion 18 and a bow string 20. An adjustable stabilizer mounting device generally indicated at 22 is shown mounted on the forward face of the bow 10 below the hand grip portion 18. It is to be understood that the stabilizer mounting device 22 with a pair of stabilizers mounted thereon may be mounted on a front or rear face of a bow above or below the hand grip portion 18, or two stabilizer mounting devices 22 each having a pair of stabilizers may be mounted on the bow, one above and one below the hand grip portion 18.

The adjustable stabilizer mounting device comprises a mounting bar 24 of D-shape cross sectional configuration. The mounting bar 24 is provided with a transverse clearance bore 26 therethrough intermediate of its length which receives a machine screw 28 having a knurled cylindrical head 30. The mounting bar 24 is mounted on the bow 10 perpendicular to the longitudinal center line of the bow with the flat surface portion 32 thereof lying against a forward face of the bow. The mounting bar 24 is at least of sufficient length to extend to opposite sides of the bow. For bows having metal handle sections 16 the machine screw 28 is received in a screw threaded hole in the handle section and for bows having a wood or non-metallic handle section an internally screw threaded metal bushing conventionally employed in mounting stabilizers on wood handle sections is employed to receive screw 28.

Mounted at each end of mounting bar 24 is a rotatably adjustable member 34 of generally cylindrical shape and having an inner beveled face portion 36. The members 34 have a central clearance holes 38 therethrough and are attached to the ends of mounting bar 24 by cap screws 40 neatly fitting the clearance holes 38 and threadedly engaged in screw threaded bores 42 extending longitudinally into the ends of bar 24. The cap screws 40 are provided with Allen wrench sockets 44. To rotatably adjust members 34 the cap screws 40 are loosened sufficiently to permit their rotation and then tightened when the member is rotated to a desired angular position.

Figure 3:
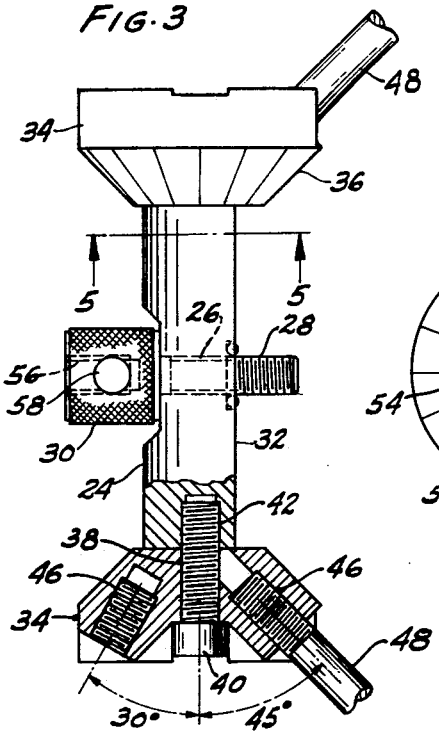
FIG. 3 is an enlarged plan view of the stabilizer mounting device shown in FIG. 2 with parts shown in cross section.
Figure 5:
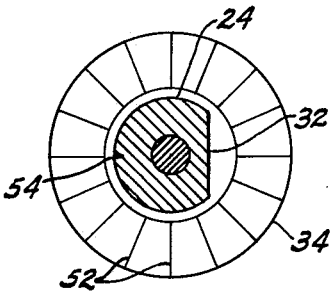
FIG. 5 is an enlarged cross sectional view taken along line 5—5 of FIG. 3.
Figure 4:
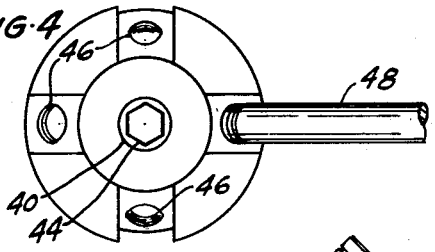
FIG. 4 is an enlarged end elevational view of the stabilizer mounting device.
Figure 2:
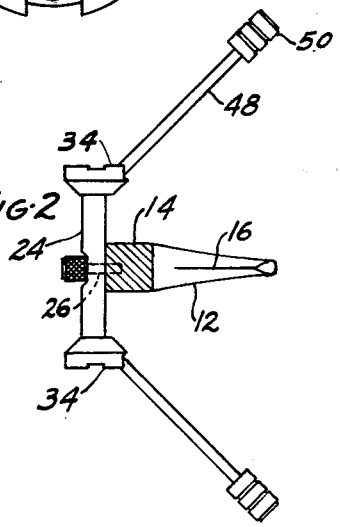
FIG. 2 is a plan view of the stabilizer mounting device shown in FIG. 1, and is taken along line 2—2 of FIG. 1.
Figure 6:
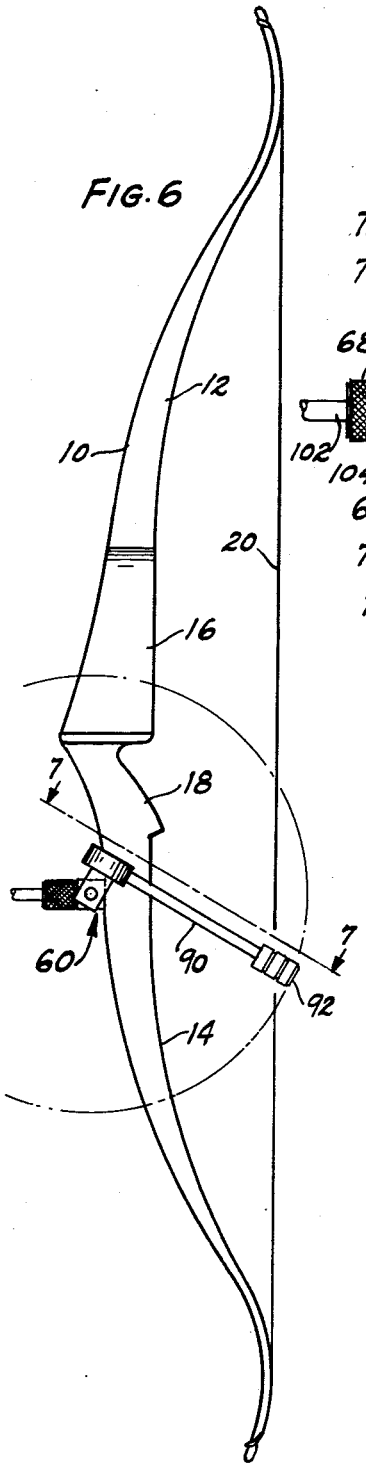
FIG. 6 is a side elevational view of an archery bow having mounted thereon a second form of adjustable stabilizer mounting means with stabilizers attached and is constructed in accordance with the invention.
Figure 9:
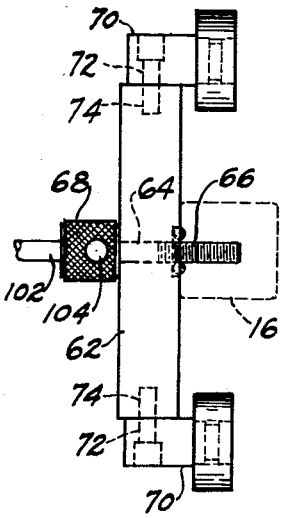
FIG. 9 is a side elevational view of the stabilizer mounting device shown in FIG. 8.
Figure 10:
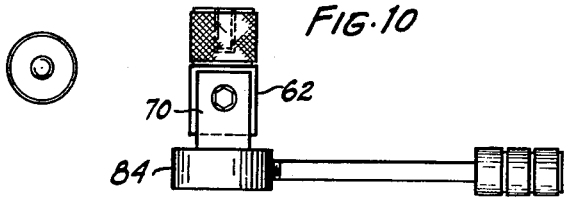
FIG. 10 is an end elevational view of the stabilizer mounting device of FIG. 9.
Figure 8:
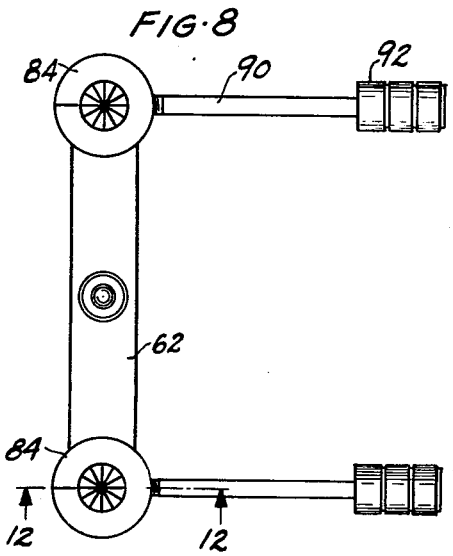
FIG. 8 is an enlarged plan view of the stabilizer mounting device shown in FIGS. 6 and 7.
Figure 13:
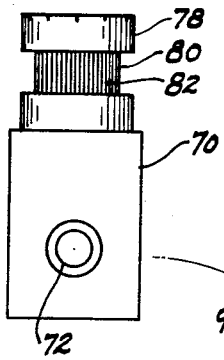
FIG. 13 is an enlarged elevational view of a first rotatably adjustable member shown alone.
Figure 11:
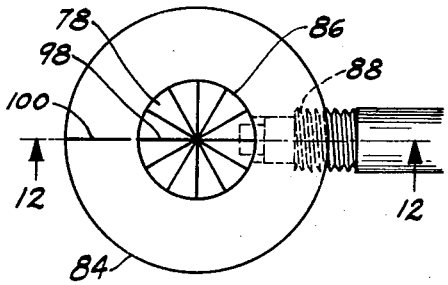
FIG. 11 is a further enlarged fragmentary view of one end portion of the stabilizer mounting device shown in FIG. 8.
Figure 7:
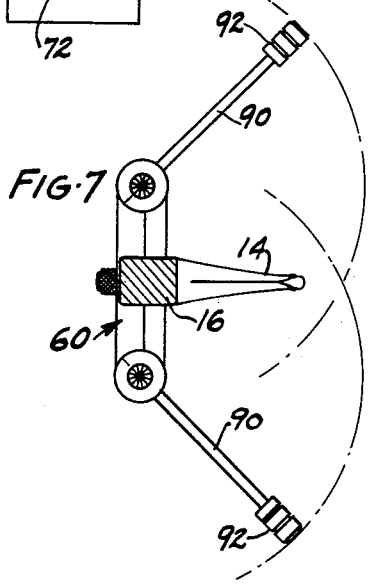
FIG. 7 is a plan view of the stabilizer mounting device shown in FIG. 6 and is taken along line 7—7 of FIG. 6.

Each of the rotatably adjustable members 34 is provided with one or more screw threaded bores 46 which is adapted to receive a screw threaded end of a stabilizer rod 48 having a weighting element 50 at its other end. The screw threaded bores 46 extend into members 34 at diverse acute angles to an outwardly projected longitudinal center line of the cap screw 40, as shown in FIG. 3. By way of example, each of the members 34 may have four screw threaded bores 46, two of which may lie at angles of 30° and 45° respectively to an outward projection of the longitudinal center line of the cap screws and two others which may lie at acute angles greater than 45° thereto.

The inner bevelled faces 36 of members 34 are provided with radial scored lines 52 of equal angular spacing and the mounting bar 24 is provided with a scored index line 54 at each end. The angularly spaced lines 52 may include indicia (not shown) to indicate the angularly adjusted positions of the members 34 in degrees.

It will be seen that the stabilizers may be adjusted angularly through a 360° range so that the rods 48 and weights 50 may be extended rearwardly or forwardly of the bow and that by selectively entering the rods 48 in the screw threaded holes 46 the outward angle of the rods 48 and outward spacing of the weighting elements 50 with respect to opposite sides of the bow may be varied. Removable plugs (not shown) may be provided to close those screw threaded holes 46 not in use.

The knurled cylindrical head 30 of machine screw 28 is provided with longitudinal screw threaded bore 56 which is adapted to receive the screw threaded end of the rod of an additional forwardly extending stabilizer if desired when the mounting device 22 is mounted on a forward face of the bow 10 as shown in FIG. 1. The knurled cylindrical head 30 of machine screw 28 is also provided with a transverse through bore 58 into which an Allen wrench may be inserted to facilitate drawing up screw 28 tightly.

FORM OF ADJUSTABLE STABILIZER MOUNTING DEVICE OF FIGS. 6 TO 13.

Referring to FIGS. 6 to 13 of the drawings a second form of adjustable stabilizer mounting device generally indicated at 60 is shown attached to the forward face of the bow 10 below the hand grip portion 18. It is to be understood that the stabilizer mounting device 60 may also be mounted on the rear face of the bow below the hand grip 18 as illustrated or on the front or rear face of a bow above the hand grip portion 18. Also more than one adjustable stabilizer device 60 may be mounted on a bow.

The adjustable stabilizer mounting device 60 includes a mounting bar 62 of rectangular cross section. Mounting bar 62 is provided with a transverse clearance bore 64 intermediate of its length which receives a machine screw 66 having a knurled cylindrical head 68. The mounting bar 62 is adapted to be mounted on a forward or rear face of a bow perpendicular to the longitudinal center line of the bow as shown and the length of bar 62 is at least sufficient to extend slightly beyond opposite sides of a bow. Machine screw 66 is entered into a screw threaded bore in the bow when the bow handle section is constructed of metal or into a suitable metal adapter bushing when the handle section is of wood construction.

Mounted at each end of mounting bar 62 is a rotatably adjustable member 70 constructed of metal. The members 70 have a smooth clearance hole 72 therethrough and are mounted for rotational adjustment on cap screws 74 which neatly fit clearance holes 72 and are threadedly engaged in longitudinally extending screw threaded bores in the ends of mounting bar 62. The cap screws 74 are provided with Allen wrench sockets 76.

The rotatably adjustable members 70 are each provided with a cylindrical stud portion 78 extending from one side thereof perpendicularly to the clearance hole 72. The cylindrical stud portion 78 has an intermediate reduced diameter portion 80, see FIGS. 12 and 13, the surface of which is serrated or straight line knurled as indicated at 82. Mounted for rotation on the cylindrical stud portion 78 of each of the members 70 is a second cylindrical rotatably adjustable member 84. Members 84 each have a central through bore 86 which is snugly fitted for rotation on the stud portions 78 of members 70.

Figure 12:
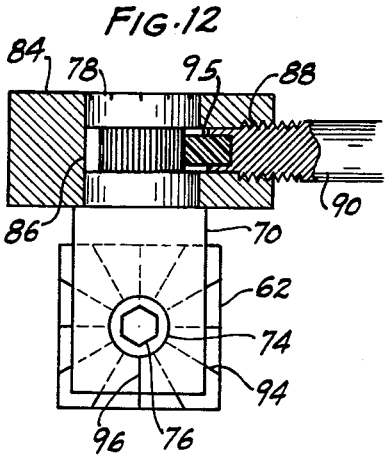
FIG. 12 is an enlarged fragmentary view partly in cross section taken along lines 12—12 of FIGS. 8 and 11.

Cylindrical rotatably adjustable members 84 are each further provided with a screw threaded bore 88 perpendicular to and intersecting the central bore 86 in alignment with the reduced diameter knurled portion 80 of stud 78, see FIG. 12. The screw threaded end of a stabilizer rod 90 is threadedly engaged in the screw threaded bore 88 of each of members 84. Each of the stabilizer rods 90 has a weighting element 92 at its outer end. Fitted into a recess in the screw threaded end of each stabilizer rod 90 is a pliable, non-metallic cylindrical member 95 which be constructed of a synthetic thermoplastic material such as nylon. The member 95 is arranged to engage the knurled surface 80 when the stabilizer rod 90 is screwed inward. Deformation of the pliable member 95 by the knurled metal surface 80 when stabilizer rod 90 is screwed inwardly prevents rotation of members 84 and secures them in an angularly adjusted position.

The ends of mounting bar 62 are provided with angularly spaced radial score lines 94 and the members 70 with an indexing score line 96. Also the outer flat ends of cylindrical stud portions 78 of members 70 are provided with angularly spaced radial score lines 98 and the members 84 with an indexing score line 100. The knurled cylindrical head 68 of machine screw 66 is provided with an axial screw threaded bore arranged to receive the screw threaded end of an additional stabilizer rod fragmentarily indicated at 102 in FIGS. 6 and 9.

It is to be further understood that flexible couplings may be employed between the screw threaded ends of the stabilizer rods 48 and 90 and the rotatably adjustable members 34 and 84, respectively, of the first and second described forms of the present invention. When such couplings are employed screw threaded studs conventionally provided on currently available commercial flexible couplings will be entered into the screw threaded bores 46 and 88, respectively, of members 34 and 84 and the screw threaded ends of the stabilizer rods will be engaged in screw threaded bores conventionally provided in such flexible couplings. Also when flexible couplings are employed intermediately of the screw threaded ends of stabilizer rods 90 and rotatably adjustable members 84 of the second described form of mounting device, then the screw threaded studs on the flexible couplings which enter screw threaded bores 88 will be provided with pliable elements 95 in the ends thereof for the purpose described.

It will be seen from the foregoing that the adjustable stabilizer mounting means of FIGS. 6 to 13 provides for universal angular extension of the rods of a pair of stabilizers from opposite sides of the bow both horizontally and vertically through a range which permits positioning the weighting elements forwardly or rearwardly of the bow.

I claim:

1. A device for mounting a pair of stabilizers on an archery bow so that they may be conveniently extended at various angles from opposite sides of a bow comprising; an elongated mounting bar adapted to be mounted transversely on a forward or rear face of a bow with the ends thereof extending from opposite sides of a bow, said bar including means intermediate of its length for rigidly attaching it to a bow, a rotatably adjustable member pivotally mounted on each end of said elongated mounting bar for rotation on an axis parallel to said bar and perpendicular to the bow, pivot means for so mounting said members on the ends of said bar including screw threaded means for securing said members in a rotatably adjusted position, a stabilizer comprising a rod having a weighting element at one end connected at its other end to each of said members, and screw threaded means for connecting the said other ends of said stabilizers to said members.

2. The device claimed in claim 1 in which said rotatably adjustable members each include at least one screw threaded bore extending therein at an acute angle to an outward projection of its axis of rotation, and said screw threaded means connecting the said other ends of said stabilizer rods to said members being entered into said screw threaded bores in said members.

3. The device claimed in claim 1 in which said rotatably adjustable members each include a plurality of spaced screw threaded bores extending therein at diverse acute angles to an outward projection of its axis of rotation and said screw threaded means connecting said other ends of said stabilizer rods to said members being selectively entered into one or the other of said plurality of screw threaded bores.

4. The device claimed in claim 1 in which said means for rigidly attaching said mounting bar to a bow comprises a machine screw having an elongated cylindrical head, and said head having a longitudinal screw threaded bore therein adapted to receive screw threaded means for attaching one end of a stabilizer rod thereto.

5. The device claimed in claim 1 in which the sides of said rotatably adjustable members adjacent the ends of said mounting bar are provided with angularly spaced lines extending radially from their center of rotation, and in which said mounting bar is provided with an indexing mark at each end thereof for registration with said radial lines.

6. A device for mounting a pair of stabilizers on an archery bow so that they may be conveniently extended at various angles from opposite sides of a bow comprising: an elongated mounting bar adapted to be mounted transversely on a forward or rear face of a bow with the ends thereof extending from opposite sides of the bow, said mounting bar including means intermediate of its length for rigidly attaching it to a bow, a first rotatably adjustable member pivotally mounted on each end of said mounting bar for rotational adjustment on an axis parallel to said elongated bar and perpendicular to the bow, pivot means for so mounting said members on the ends of said bar including screw threaded means for securing said members in rotatably adjusted positions, a second rotatably adjustable member pivotally mounted for rotation on each of said first members for rotation on an axis perpendicular to the axis of rotation of said first members, pivot means for so mounting said second members on said first members including screw threaded means for securing said second members in rotatably adjusted positions, a stabilizer comprising a rod having a weighting element at one end connected at its other end to each of said second members, and screw threaded means connecting the said other ends of said stabilizer rods to said second members.

7. The device claimed in claim 6 in which said pivot means for rotatably mounting said second members on said first members comprises a cylindrical stud portion extending from each of said first members perpendicular to the axis of rotation of said first members, in which said second members are each provided with a smooth through bore receiving said cylindrical stud portion for rotation thereon, in which each of said second members has a screw threaded bore extending therein perpendicular to and intersecting said smooth through bore, and in which said screw threaded means connecting the said other ends of said stabilizer rods to said second members are threadedly engaged in said screw threaded bores in said second members and engage said cylindrical stud portions to prevent rotation of said second members thereon when said screw threaded means are screwed in tightly.

8. The device claimed in claim 7 in which an intermediate surface portion of each of said cylindrical stud portions is serrated, and in which said screw threaded means connecting the said other ends of said stabilizer rods to said second members are provided with pliable, deformable elements which engage the serrated surface portion of said cylindrical stud portion.

9. The device claimed in claim 7 in which said cylindrical stud portions on said first members extend completely through said smooth bores in said second members and are provided at their ends with angularly spaced lines extending radially from their centers, and in which said second members are provided with an index line for registration with said angularly spaced radial lines on the ends of said cylindrical stud portions.

10. The device claimed in claim 6 in which the ends of said mounting bar are provided with angularly spaced lines extending radially from the center of rotation of said first members, and in which said first members are provided with an index mark for registration with said angularly spaced radial lines.

* * * * *